US007854544B2

(12) United States Patent
Cheng et al.

(10) Patent No.: US 7,854,544 B2
(45) Date of Patent: Dec. 21, 2010

(54) CORRECTION APPARATUS AND CLOCK DEVICE USING THE SAME

(75) Inventors: Chun-Ming Cheng, Taipei County (TW); Chia-Bo Lin, Taipei (TW)

(73) Assignee: Princeton Technology Corporation, Taipei County (TW)

( * ) Notice: Subject to any disclaimer, the term of this patent is extended or adjusted under 35 U.S.C. 154(b) by 196 days.

(21) Appl. No.: 11/898,178

(22) Filed: Sep. 10, 2007

(65) Prior Publication Data

US 2008/0316867 A1 Dec. 25, 2008

(30) Foreign Application Priority Data

Jun. 20, 2007 (TW) ..... 96210004 U

(51) Int. Cl.
*G04B 18/00* (2006.01)

(52) U.S. Cl. ..... 368/200

(58) Field of Classification Search ..... 368/156–157, 368/200–202; 331/46, 47, 116, 176; 395/555; 370/519

See application file for complete search history.

(56) References Cited

U.S. PATENT DOCUMENTS 6,304,517 B1 * 10/2001 Ledfelt et al. ..... 368/10
6,556,512 B1 * 4/2003 Winkler ..... 368/47
7,272,720 B2 * 9/2007 Hasebe et al. ..... 713/178
2001/0022536 A1 * 9/2001 Kallio et al. ..... 331/1 R
2003/0174587 A1 * 9/2003 Bening ..... 368/200
2004/0012415 A1 * 1/2004 Kouzuma ..... 327/113
2004/0125824 A1 * 7/2004 Preston et al. ..... 370/519
2004/0162046 A1 * 8/2004 Yamauchi et al. ..... 455/260
2006/0045215 A1 * 3/2006 Ballantyne et al. ..... 375/344
2006/0238415 A1 * 10/2006 Gilkes ..... 342/357.02

* cited by examiner

*Primary Examiner*—Edwin A. Leon
(74) *Attorney, Agent, or Firm*—Muncy, Geissler, Olds & Lowe, PLLC

(57) ABSTRACT

A clock device is provided for generating a real-time clock. The clock device includes a frequency generator, a measuring module, a setting module and a timing module. The frequency generator generates a frequency signal. The measuring module is coupled to the frequency generator for measuring the frequency signal and generating a measuring frequency value. The setting module is coupled to the measuring module for generating an error setting value corresponding to the measuring frequency value. The timing module is coupled to the frequency generator and the setting module for compensating the frequency signal according to the error setting value and generating the real-time clock.

9 Claims, 2 Drawing Sheets

CORRECTION APPARATUS AND CLOCK DEVICE USING THE SAME

BACKGROUND OF THE INVENTION

1. Field of the Invention

The invention relates to a correction apparatus, and more particularly to a correction apparatus for correcting a real-time clock (RTC).

2. Description of the Related Art

A real-time clock (RTC) is usually included in an electrical product for displaying real-time time information on a panel, or for displaying a user's preset time for automatically turning on and off the electrical product.

A conventional RTC is comprised of a crystal oscillator in cooperation with a resistor-capacitor (R-C) circuit. The problem with conventional RTCs is that the time for the RTC in the electrical product will become inaccurate, causing the electrical product to display an incorrect time. Time inaccuracies may be due to process drift, aging of electrical components, or circuit mismatch. One electrical product using an RTC is a computer system. It is important for computer systems to execute software programs with accurate time and date information. Once the RTC in a computer system losses its accuracy, the computer system will become inefficient and may even malfunction due to time error.

BRIEF SUMMARY OF THE INVENTION

A correction apparatus for correcting a real-time clock is provided. An exemplary embodiment of the correction apparatus comprises a measuring module, a setting module, and a timing module. The measuring module is used for measuring the frequency signal and generating a measuring frequency value. The setting module is coupled to the measuring module for generating an error setting value corresponding to the measuring frequency value. The timing module is coupled to the setting module for compensating the frequency signal according to the error setting value and generating the real-time clock.

Another exemplary embodiment of a clock device is provided for generating a real-time clock. The clock device comprises a frequency generator, a measuring module, a setting module and a timing module. The frequency generator is used for generating a frequency signal. The measuring module is coupled to the frequency generator for measuring the frequency signal and generating a measuring frequency value. The setting module is coupled to the measuring module for generating an error setting value corresponding to the measuring frequency value. The timing module is coupled to the frequency generator and the setting module for compensating the frequency signal according to the error setting value and generating the real-time clock.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
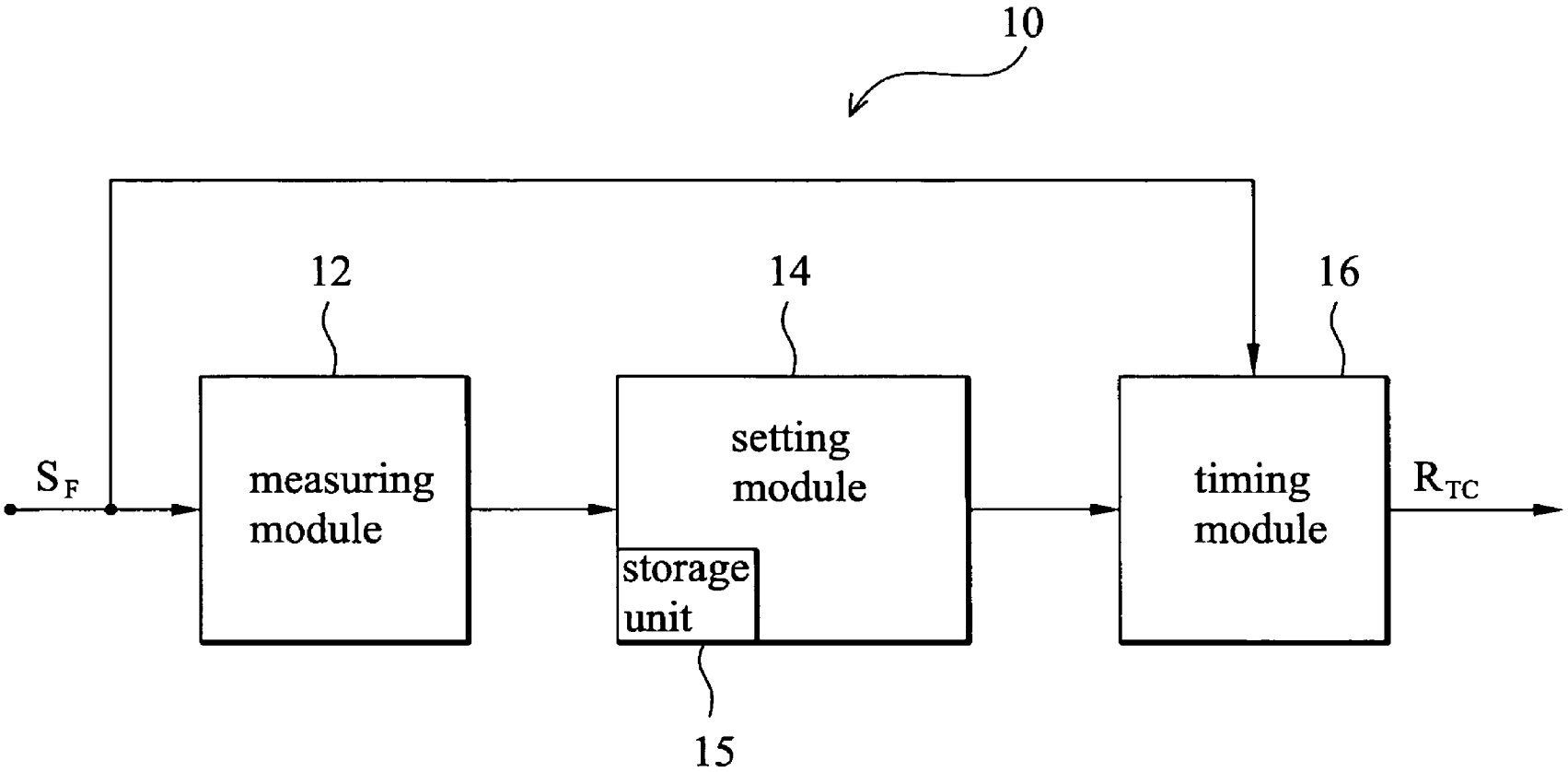
FIG. 1 illustrates a block diagram of a correction apparatus according to an embodiment of the present invention.

FIG. 1 illustrates the block diagram of a correction apparatus according to an embodiment of the present invention. In FIG. 1, correction apparatus 10 corrects a frequency signal $S_F$ in a clock device (not shown) and generates a real-time clock $R_{TC}$. Correction apparatus 10 comprises a measuring module 12, a setting module 14, and a timing module 16. Measuring module 12 measures the frequency signal $S_F$ and generates a measuring frequency value. In one embodiment of the invention, measuring module 12 is a frequency measuring instrument for measuring the frequency of the frequency signal $S_F$ and generating the measuring frequency value according to the measuring result. Setting module 14 is coupled to the measuring module 12 and generates a corresponding error setting value according to the measuring frequency value. In one embodiment of the invention, setting module 14 comprises a storage unit 15. Storage unit 15 stores a mapping table (not shown). This mapping table comprises a plurality of frequency values and a plurality of error setting values, wherein each of the frequency values respectively corresponds to one of the error setting values. Setting module 14 looks up the data recorded in the mapping table according to the measuring frequency value, and retrieves a corresponding error setting value. Timing module 16 is coupled to the setting module 14 for compensating the measuring frequency value according to the corresponding error setting value, and generating real-time clock $R_{TC}$.

Figure 2:
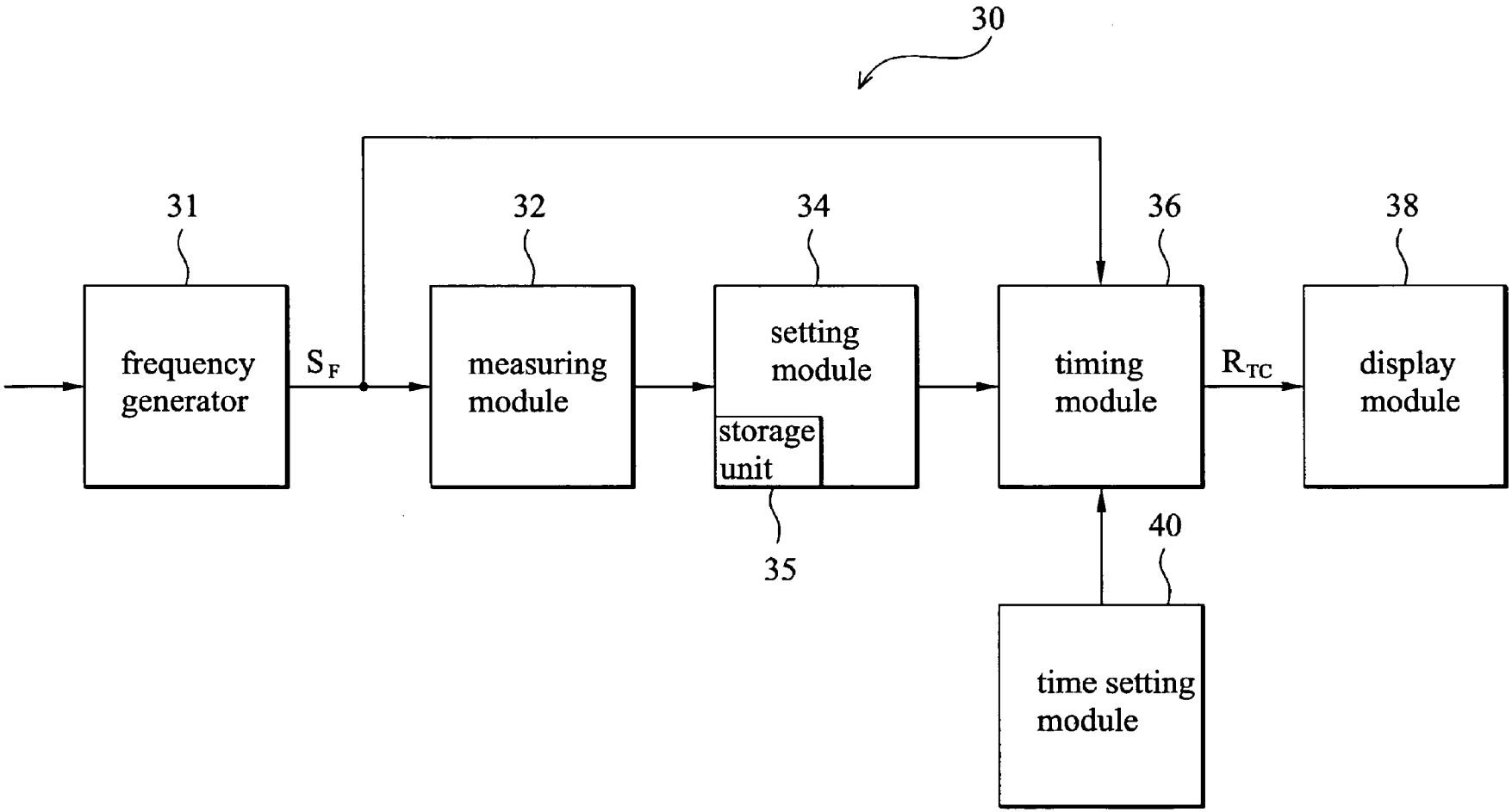
FIG. 2 illustrates a block diagram of a clock device according to another embodiment of the present invention.

FIG. 2 illustrates the block diagram of a clock device 30 for generating a real-time clock $R_{TC}$ according to another embodiment of the present invention. Clock device 30 comprises a frequency generator 31, a measuring module 32, a setting module 34, and a timing module 36. Frequency generator 31 generates a frequency signal $S_F$. In one embodiment of the invention, frequency generator 31 is an oscillator. Measuring module 32 measures the frequency signal $S_F$ and generates a measuring frequency value. In one embodiment of the invention, measuring module 32 is a frequency measuring instrument for measuring the frequency of the frequency signal $S_F$ and generating the measuring frequency value according to the measuring result. Setting module 34 is coupled to the measuring module 32 and generates a corresponding error setting value according to the measuring frequency value. Timing module 36 is coupled to the frequency generator 31 and setting module 34 for compensating the measuring frequency value according to the corresponding error setting value and generating real-time clock $R_{TC}$.

In one embodiment of the invention, setting module 34 comprises a storage unit 35 for storing a mapping table (not shown) with a plurality of frequency values and a plurality of error setting values, wherein each of the frequency values corresponds to one of the error setting values. Setting module 34 generates an error setting value according to the mapping table and the measuring frequency value.

Clock device 30 further comprises a display module 38 coupled to the timing module 36. Thus, the clock device 30 displays the corrected time according to the real-time clock $R_{TC}$ on the display module 38. Moreover, clock device 30 further comprises a time setting module 40 coupled to the timing module 36 for setting the real-time clock $R_{TC}$. Time setting module 40 provides an interface to allow users to set the current time, for example, when the clock device 30 is in a different time area, users may set the time information of clock device 30 according to the different time area information on their own.

In one embodiment of the present invention, timing module 36 compensates the frequency signal and generates the real-time clock according to the error setting value within a preset time period. For example, if the frequency of frequency signal $S_F$ generated by frequency generator 31 is 32768 Hz and the time period is set at 1 second, and the frequency measured by measuring module 32 is 32767.6 Hz, than the clock device 30 has an error of 0.4 Hz, which would be adjusted after 1 second. However, because the error is minimal, a user can set the time period for correcting errors according to the user's preference. For example, the user can set the time period for 10 seconds, thus, frequency correction will be performed every 10 seconds or any length of time.

In the embodiments of the present invention, frequency signal is measured by a frequency measurement instrument, and frequency correction is performed in order to generate accurate time according to the measuring values after the electrical product fabrication process to ensure the quality. With the frequency correction function, the built-in clock device in each electrical product is corrected and thus is accurate and avoids problems caused by inaccurate time.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A correction apparatus correcting a frequency signal in a clock device and generating a real-time clock, the correction apparatus comprising:

a measuring module measuring the frequency signal to obtain a factual value of the frequency signal;

a setting module coupled to the measuring module for generating an error setting value wherein a mapping table in the setting module stores a plurality of error setting values each error setting value corresponds to a frequency value, the setting module compares the factual value of the frequency signal with the frequency value though the mapping table to determine the error setting value for correction of the frequency signal; and a timing module coupled to the setting module for correcting the frequency signal by the error setting value to generate the real-time clock.

2. The correction apparatus as claimed in claim 1, wherein the timing module corrects the frequency signal by the error setting value to generate the real-time clock within a preset time period.

3. The correction apparatus as claimed in claim 1, wherein the measuring module is a frequency measuring instrument to obtain the factual value of the frequency signal by measuring a frequency value of the frequency signal.

4. A clock device generating a real-time clock, the clock device comprising:

a frequency generator generating a frequency signal;

a measuring module coupled to the frequency generator for measuring the frequency signal to obtain a factual value of the frequency signal;

a setting module coupled to the measuring module for generating an error setting value wherein a mapping table in the setting module stores a plurality of error setting values, each error setting value corresponds to a frequency value, the setting module compares the factual value of the frequency signal with the frequency value though the mapping table to determine the error setting value for correction of the frequency signal; and a timing module coupled to the frequency generator and the setting module for correcting the frequency signal by the error setting value to generate the real-time clock.

5. The clock device as claimed in claim 4, wherein the timing module corrects the frequency signal by the error setting value to generate the real-time clock within a preset time period.

6. The clock device as claimed in claim 4, wherein the frequency generator is an oscillator.

7. The clock device as claimed in claim 4, further comprising a time setting module coupled to the timing module for setting the real-time clock.

8. The clock device as claimed in claim 4, further comprising a display module coupled to the timing module for displaying the real-time clock.

9. The clock device as claimed in claim 4, wherein the measuring module is a frequency measuring instrument to obtain the factual value of the frequency signal by measuring a frequency value of the frequency signal.

* * * * *